US007847736B2

(12) United States Patent
Channabasappa

(10) Patent No.: US 7,847,736 B2
(45) Date of Patent: Dec. 7, 2010

(54) MULTI SECTION MEANDER ANTENNA

(75) Inventor: Eswarappa Channabasappa, Acton, MA (US)

(73) Assignee: Cobham Defense Electronic Systems, Bolton, MA (US)

( * ) Notice: Subject to any disclaimer, the term of this patent is extended or adjusted under 35 U.S.C. 154(b) by 195 days.

(21) Appl. No.: 11/466,997

(22) Filed: Aug. 24, 2006

(65) Prior Publication Data

US 2008/0048929 A1 Feb. 28, 2008

(51) Int. Cl.
*H01Q 1/38* (2006.01)
*H01Q 1/36* (2006.01)

(52) U.S. Cl. ..... 343/700 MS; 343/895

(58) Field of Classification Search ..... 343/700 MS, 343/895, 846, 893, 702
See application file for complete search history.

(56) References Cited

U.S. PATENT DOCUMENTS

| | | | | |
|---|---|---|---|---|
| 6,351,241 | B1 | 2/2002 | Wass | |
| 6,624,795 | B2 | 9/2003 | Boyle | |
| 6,642,893 | B1 | 11/2003 | Hebron et al. | |
| 6,680,701 | B2 * | 1/2004 | Sung | 343/700 MS |
| 6,842,143 | B2 | 1/2005 | Otaka et al. | |
| 6,987,483 | B2 * | 1/2006 | Tran | 343/700 MS |
| 6,995,714 | B2 * | 2/2006 | Sim et al. | 343/702 |
| 7,106,258 | B2 * | 9/2006 | Kuramoto | 343/700 MS |
| 7,274,334 | B2 * | 9/2007 | O'Riordan et al. | 343/702 |
| 7,339,533 | B2 * | 3/2008 | Kurashima et al. | 343/702 |
| 2001/0011964 | A1 | 8/2001 | Sadler et al. | |
| 2002/0118142 | A1 | 8/2002 | Wang | |
| 2006/0267844 | A1 * | 11/2006 | Yanagi et al. | 343/700 MS |
| 2007/0001925 | A1 * | 1/2007 | Bae et al. | 343/895 |

FOREIGN PATENT DOCUMENTS

| | | | |
|---|---|---|---|
| EP | 0 969 547 A2 | | 1/2000 |
| JP | 2001217632 | * | 8/2001 |
| WO | WO 01/11721 A1 | | 2/2001 |

OTHER PUBLICATIONS

Shin, Y-S, et al., A Broadband Interior Antenna of Planar Monopole Type in Handsets, IEEE Antennas and Wireless Propagation Letters, vol. 4, 2005, pp. 9-12.
Sim, D-U, et al., An Internal Triple-Ban Antenna for PCS/IMT-2000/ Bluetooth Applications, IEEE Antennas and Wireless Propagation Letters, vol. 3, 2004, pp. 23-25.
Sim, D-U, et al., A Wideband Monopole Antenna for PCS/IMT-2000/ Bluetooth Applications, IEEE Antennas and Wireless Propagation Letters, vol. 3, 2004, pp. 45-47.
Lin, C-C, et al., A 2.4-GHz Printed Meander-Line Antenna for USB WLAN With Notebook-PC Housing, IEEE Microwave and Wireless Components Letters, vol. 15, No. 9, Sep. 2005, pp. 546-548.
Olsson, R, et al., The Eleven Antenna: A Compact Low-Profile Decade Bandwidth Dual Polarized Feed for Reflector Antennas, IEEE Transactions on Antennas and Propagation, vol. 54, No. 2, Feb. 2006, pp. 368-375.
European Search Report, Application No. EP 07 11 4443, Dated Nov. 22, 2007.

* cited by examiner

*Primary Examiner*—Jacob Y Choi
*Assistant Examiner*—Robert Karacsony
(74) *Attorney, Agent, or Firm*—Jaeckle Fleischmann & Mugel LLP

(57) ABSTRACT

An antenna formed on a dielectric substrate having first and second opposing surfaces, a first meander antenna element disposed on the first surface of the substrate and a second meander antenna element disposed on the second surface of the substrate.

23 Claims, 7 Drawing Sheets

10-dB bandwidth = 1651 MHz 10-dB bandwidth = 1800 MHz

MULTI SECTION MEANDER ANTENNA

STATEMENT OF GOVERNMENT RIGHTS

This invention was developed in part in part with Government support under a subcontract for prime Contract No. HR0011-04-C-0049. The federal government may have certain rights in this invention.

BACKGROUND

1. Field of the Invention

The invention pertains to multi band or ultra wide band antennas. More particularly, the invention pertains to multi band or ultra wide band meander antennas.

2. Background of the Invention

Transmitters and transceivers used in wireless communication devices, such as cellular telephones, require antennas of small size and light weight. This is particularly true in connection with portable wireless devices, such as cellular telephones. Many cellular telephones utilize external antennas. Many wireless communication devices must be able to operate over a very wide frequency bandwidth. For instance, in the case of multi-band cellular telephones, they must be able to operate in two or more disparate frequency bands, such as GSM (approximately 900 MHz) and PCS (approximately 1.9 GHz). Accordingly, they must have antennas that are able to transmit and/or receive effectively in both bandwidths.

One simple solution is to provide the telecommunication device with two (or more) separate antennas, each adapted to operate efficiently in one of the given bands. However, this solution is less than ideal because it increases cost, weight, and size of the telecommunications device.

Ultra wide band (UWB) systems also are becoming more and more common. Such systems are used by the military and the public and have extremely wide bandwidths, such as 3-10 GHz or 0.9-6 GHz. Such systems are used, for instance, in high-resolution radar systems. Future military and commercial radios are also expected to have extremely wide bandwidths.

Meander antennas are becoming increasingly popular because they are compact in size, easy to fabricate, light in weight and have omni-directional radiation patterns. A meander antenna can be operated either as a monopole antenna element or as a dipole antenna element depending on the ground plane placement. Meander antennas comprise a folded wire printed on a dielectric substrate such as a printed circuit board (PCB) or a wire wound around a dielectric core. Meander antennas have resonance in a particular frequency band in a much smaller space than many other antenna designs. Typically, the meander antenna element is suspended above or near a ground plane. Generally, the greater the height between the meander antenna element and the ground plane, the wider the bandwidth that can be achieved.

A meander antenna, like many other types of antennas, can be made smaller by employing capacitive loading, and/or dielectric loading. The resonant frequency of a meander antenna decreases as the total wire length of the meander antenna element increases. Also, if the turns in a meander antenna are very close so as to have strong coupling, there can also be capacitive loading of the antenna, which also will increase bandwidth. Total antenna geometry, wire length, and layout can be selected so as to achieve optimal performance for a given antenna. Generally, however, the smaller the meander antenna, the smaller the frequency bandwidth.

Several techniques have been employed in the prior art to increase bandwidth of meander antennas. One technique includes increasing the distance between the meander antenna element and the ground plane.

Another technique is to cascade more than one antenna element, each element being a different size so as to have a different resonant frequency. For example, a feed line on a PCB can terminate in two different meander antenna branches having different frequencies.

A solution along these lines has been proposed in U.S. Pat. No. 6,842,143, which employs two meander antennas of different lengths connected together to cover two frequency bands. U.S. Pat. Nos. 6,642,893 also and 6,351,241 also employ two meander antennas of different lengths connected together. In both, the meander antennas are etched on a flexible dielectric substrate and the substrate is wrapped into a cylindrical shape.

Another technique employed in the past to increase bandwidth is to use a trapezoidal feeding shape, such as disclosed in Shin, Y-S, et al, A Broadband Interior Antenna Of Planar Monopole Type In Handsets, IEEE Antennas And Wireless Propagation Letters, Vol. 4, 2005.

All of these solutions have shortcomings, such as insufficient bandwidth, large volume, higher cost, and/or greater weight.

SUMMARY OF THE INVENTION

According to a first aspect, the invention pertains to an antenna formed on a dielectric substrate having first and second opposing surfaces, a first meander antenna element disposed on the first surface of the substrate and a second meander antenna element disposed on the second surface of the substrate.

According to a second aspect, the invention pertains to an antenna comprising: a planar dielectric substrate comprising first and second opposing surfaces and having a longitudinal dimension and a transverse dimension, said substrate comprising a first longitudinal segment and a second longitudinal segment contiguous with said first longitudinal segment and a first longitudinal edge at an end of said first longitudinal segment, a second longitudinal end at an end of said second longitudinal segment, a first side edge, and a second side edge opposite said first side edge; a first meander antenna element disposed on said first surface and in said second longitudinal segment of said substrate, said first meander antenna element comprising a serpentine conductive trace on said first surface of said substrate comprising a plurality of straight trace segments connected to each other by a plurality of turns and having a first end and a second end; a second meander antenna element disposed on said second surface of said substrate generally opposite said first meander antenna element, said second meander antenna element comprising a serpentine conductive trace on said second surface of said substrate comprising a plurality of straight trace segments connected to each other by a plurality of turns and having a first end and a second end; a conductive via between said first and second surfaces of said substrate disposed between said first end of said first meander antenna element and said first end of said second meander antenna element; a feed line comprising a generally straight conductive trace having a length in said longitudinal dimension of said substrate having a first end adjacent said first longitudinal end of said substrate and a second end conductively coupled to said first end of said first meander antenna element and, through said via to said first end of said second meander antenna element; and a ground plane in said first longitudinal segment and on said second surface of said substrate and conductively isolated from said first and second meander antenna elements.

DETAILED DESCRIPTION OF THE INVENTION

The invention is a meander antenna comprising two or more meander antenna elements on a planar dielectric substrate fed by a feed line, wherein at least two of the antenna elements are disposed on opposite sides of the planar dielectric substrate. They may be conductively connected to each other and the feed line by conductive vias running between the two opposing surfaces of the substrate.

The interconnection of the two or more meander antennas on opposite sides of a planar substrate can provide ultra wide bandwidth performance in a very small, lightweight, easy to manufacture, and low cost package due to the inter-element coupling of the two or more antenna elements.

Figures 1, 2, 3:
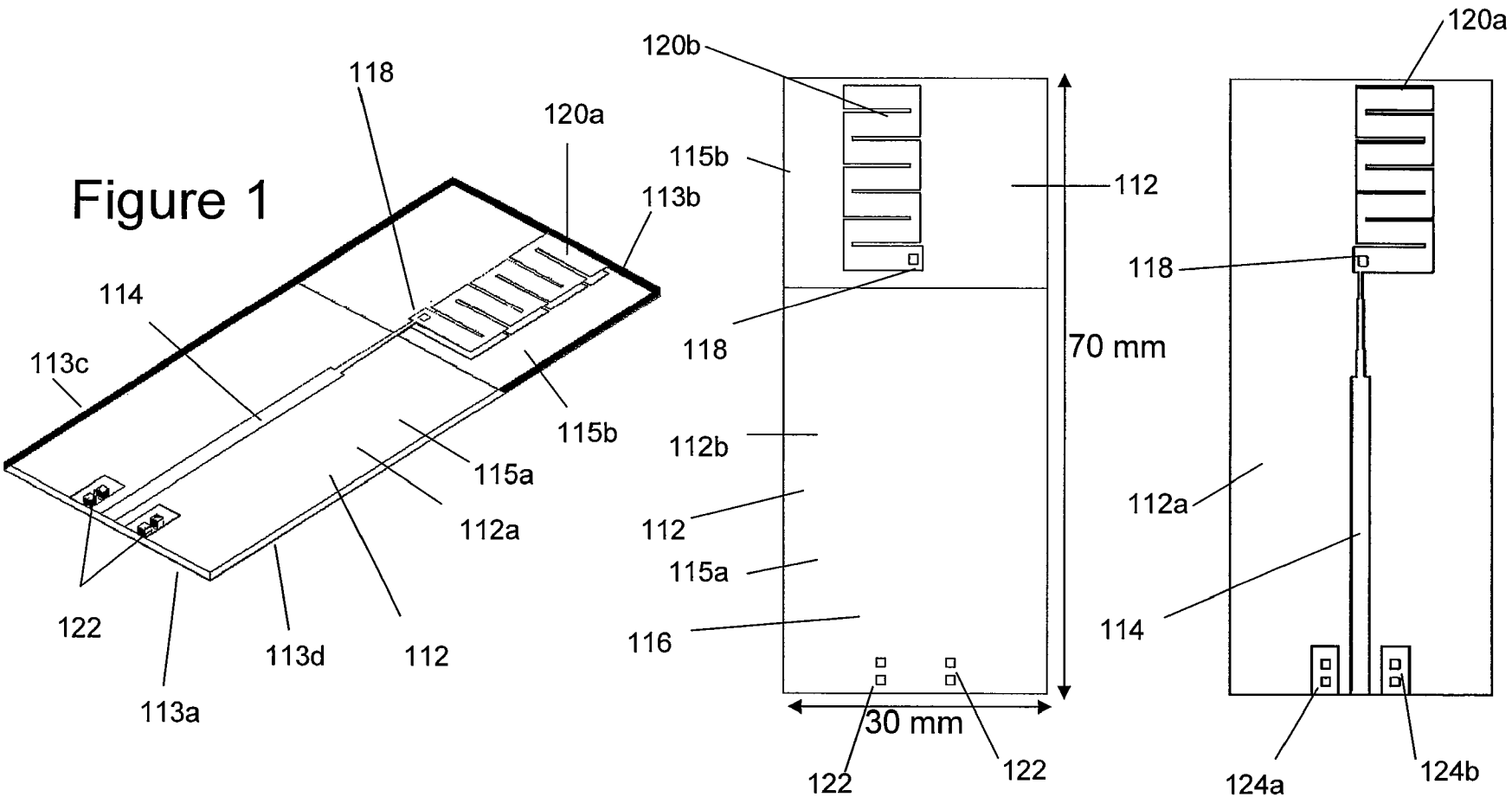
FIG. 1 is a perspective view of a two element meander antenna in accordance with the principles of the present invention.
FIG. 2 is a bottom plan view of the antenna of FIG. 1.
FIG. 3 is a top plan view of the antenna of FIG. 1.

FIGS. 1, 2, and 3 are perspective, top plan, and bottom plan views, respectively, of a first embodiment of an antenna constructed in accordance with the principles of the present invention. The antenna comprises a planar dielectric substrate 112, such as an FR4 PCB, having a top surface 112*a* and a bottom surface 112*b*. The PCB is rectangular having longitudinal edges 113*a*, 113*b* and transverse edges 113*c*, 113*d*. The top surface bears a feed line 114 conductively coupled to a first meander antenna element 120*a*. A via 118 at the end of the feed line passes through from the top surface 112*a* of the substrate 112 to the bottom surface 112*b*. The bottom surface bears a second meander antenna element 120*b* conductively coupled to the bottom of the via 118. The bottom surface 112*b* also bears a ground plane 116. In this particular embodiment, the ground plane is in a first longitudinal segment 115*a* of the substrate and spans the full transverse width of the substrate. It occupies approximately two thirds of the bottom surface 112*b* of the substrate 112. However, the ground plane can be as small as the meander antenna itself. In that case the gain of the antenna will be lower.

The bottom meander antenna element 120*b* is disposed in the other longitudinal portion 115*b* of the bottom surface 112*b* and is not conductively coupled to the ground plane.

Four additional vias 122 running between the top surface 112*a* and the bottom surface 112*b* are provided at the longitudinal end of the substrate opposite where the meander antennas are positioned. On the bottom surface, they are conductively connected to the ground plane 116. On the top surface, they are conductively connected with two metal portions 124*a*, 124*b* on opposite transverse sides of the beginning end of the feed line 114. They are designed to be coupled to the ground terminal(s) of the connector that launches the input energy into the antenna at this end of the microstrip line, as well known.

In this exemplary embodiment, the substrate 112 is FR4 having dimensions of 30 mm×70 mm and 1 mm thickness. The top meander antenna element 120*a* is 8.7 mm wide and 21.1 mm in overall length. Each transverse segment is 8.7 mm long. The gaps between these segments are 0.4 mm wide. The feed line is 36 mm long and 2 mm wide. The bottom meander antenna element is of the same size as the top one. The ground plane is 30 mm by 46 mm.

In the illustrated embodiment, each meander antenna element is dimensioned so as to have the same resonant frequency. Collectively, due to inter-element coupling, the two meander antenna elements, provide a broader frequency bandwidth for the antenna than one meander antenna element provides alone. The two meander antenna elements are appropriately coupled together to achieve larger frequency bandwidth. Alternately, the two meander antenna elements could be of slightly different sizes, but should be relatively close in dimensions so that they will efficiently couple with each other. The relative positions and sizes of the multiple antenna elements can be collectively optimized to maximize overall bandwidth.

Even greater bandwidth can be provided by adding additional meander antenna elements on the substrate, such as disclosed in connection with FIGS. 4, 5, and 6 to be discussed below. Preferably, meander antenna elements are added in pairs, one on each side of the substrate. However, this is not required.

The thickness of the substrate, which essentially dictates the vertical spacing between the ground plane on the bottom 112*b* of the substrate and the meander antenna elements on the top 112*a* of the substrate can be kept very small in order to provide a very thin antenna package. Note that the vertical spacing between the ground plane and the bottom meander antenna elements is zero because they are both on the same, bottom surface of the substrate. Specifically, the bandwidth can be made very broad by the use of multiple meander antenna elements on the opposing sides of the substrate rather than by increasing the vertical spacing between the ground plane and the meander antenna elements. Accordingly, antennas constructed in accordance with the principles of the present invention can be very thin, which is particularly important for portable telecommunication device applications, such as cellular telephones, GPS receivers, etc.

The various antenna elements interact with each other in order to provide the overall bandwidth response of the system. The dimensions of the meander antenna elements can be optimized for the desired bandwidth of the antenna using commercial simulators well-known to those of skill in the related arts.

Figures 4, 5, 6:
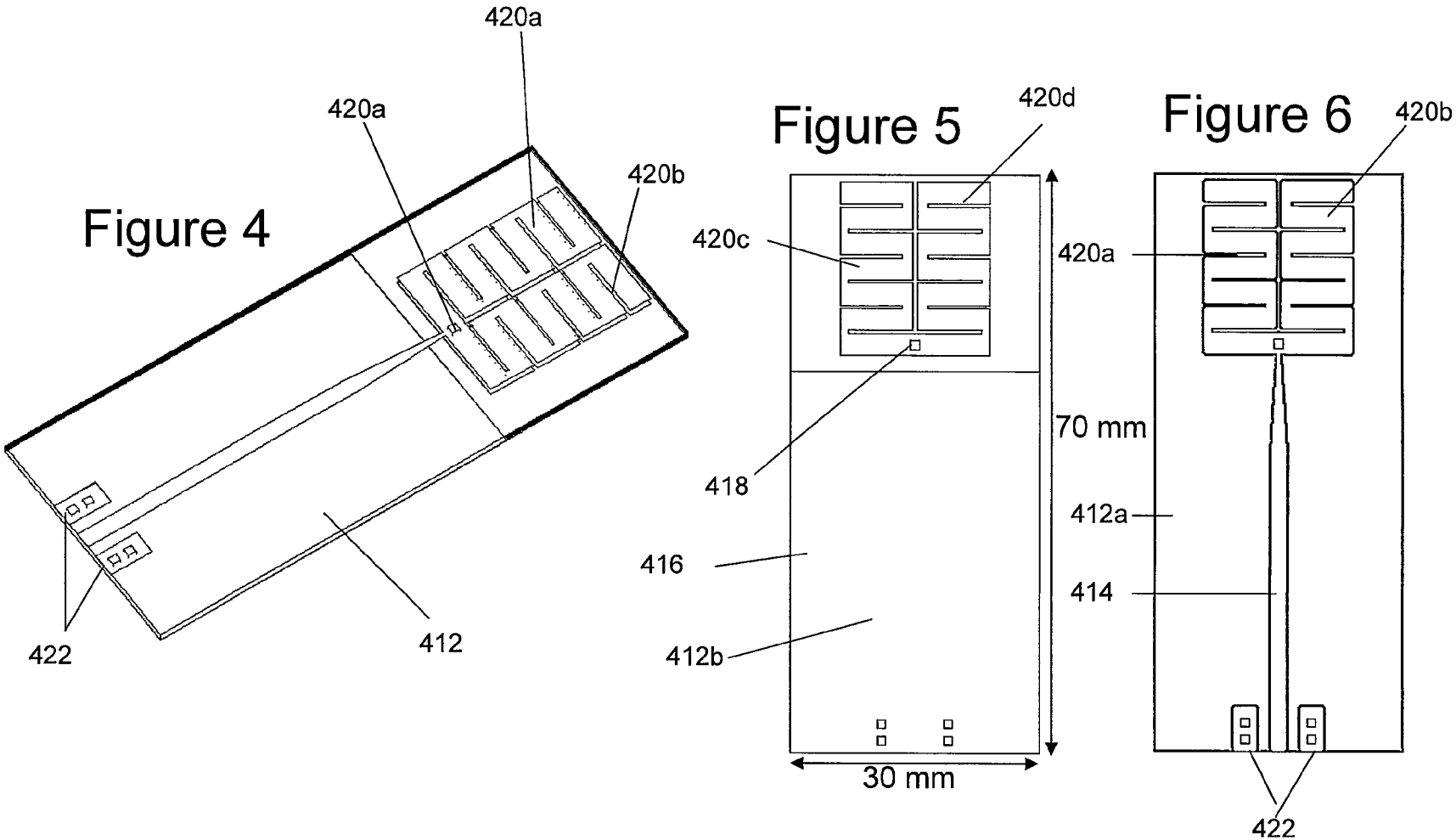
FIG. 4 is a perspective view of a four element meander antenna in accordance with the principles of the present invention.
FIG. 5 is a bottom plan view of the antenna of FIG. 4.
FIG. 6 is a top plan view of the antenna of FIG. 4.

FIGS. 4, 5, and 6 are perspective, top plan, and bottom plan views, respectively, of a second embodiment of an antenna constructed in accordance with the principles of the present invention. The antenna comprises a planar dielectric substrate 412, such as an FR4 printed circuit board (PCB), having a top surface 412*a* and a bottom surface 412*b*. The top surface bears a feed line 414 conductively coupled to first and second side-by-side meander antenna elements 420*a* and 420*b*. A via 418 at the end of the feed line passes through from the top surface 412*a* of the substrate 412 to the bottom surface 412*b*. The bottom surface bears third and fourth meander antenna elements 420*c* and 420*d* conductively coupled to the bottom end of the via 418. The bottom surface 412*a* also bears a ground plane 416. In this particular embodiment, the ground plane occupies approximately two thirds of the bottom surface 412*b* of the substrate 412. Again, the ground plane can be much smaller, in which case the antenna gain will be lower. The bottom meander antenna elements 420*c* and 420*d* are disposed in the other third of the bottom surface 412*b*.

Four additional vias 422 running between the top surface 412*a* and the bottom surface 412*b* are provided at the longitudinal end of the substrate opposite where the meander antennas are positioned as in the previously described embodiment.

In this exemplary embodiment, the substrate is made of any suitable material such as FR4 having a dimension of 30 mm×70 mm. However, both the material and the dimensions are merely exemplary and the material and particularly the dimensions of any particular antenna should be selected based on the desired frequency band and bandwidth, size requirements and other standard design considerations.

Each of the four meander antenna elements 420*a*, 420*b*, 420*c* and 420*d* is 8.7 mm wide and 21.1 mm in overall length. Each transverse segment is 8.7 mm long. The gaps between these segments are 0.4 mm wide. The ground plane is 30 mm by 46 mm.

Figure 7:
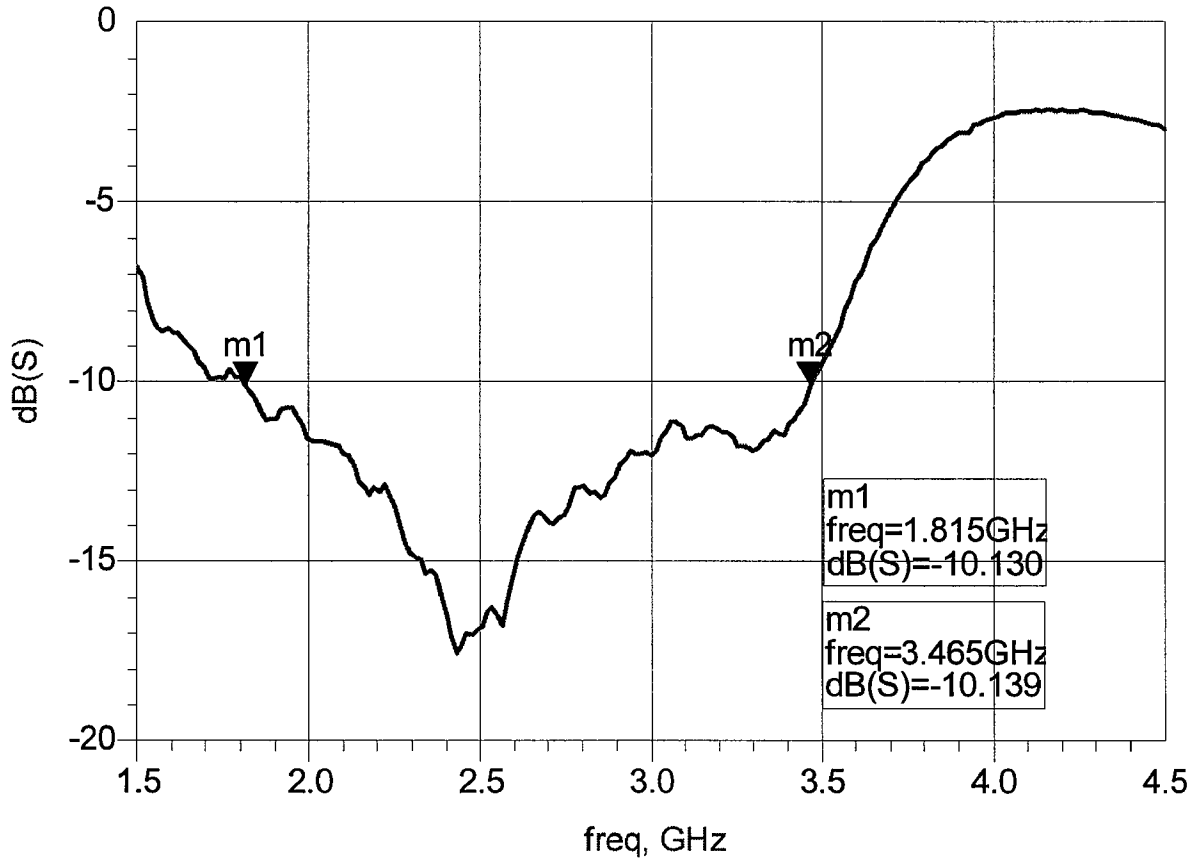
FIG. 7 is a graph showing the return loss for an exemplary two element antenna as shown in FIG. 1 constructed in accordance with the principles of the present invention.

FIG. 7 is a graph showing the return loss of the two element antenna shown in FIGS. 1, 2, and 3. As is well known in the related arts, return loss is a measurement of the input antenna loss. More particularly, it is a measurement of the portion of the input power that is returned from the antenna, i.e., that the antenna does not radiate. As can be seen in FIG. 7, the return loss for this antenna is below −10 dB between 1.815 GHz and 3.465 GHz. This is a very wide frequency bandwidth of 1.65 GHz or 62.5% (i.e., 1.65/2.64 expressed as a percentage), where 2.64 GHz is the center frequency, i.e., (1.815 GHz+3.465 GHz)/2=2.64 GHz.

Figure 8:
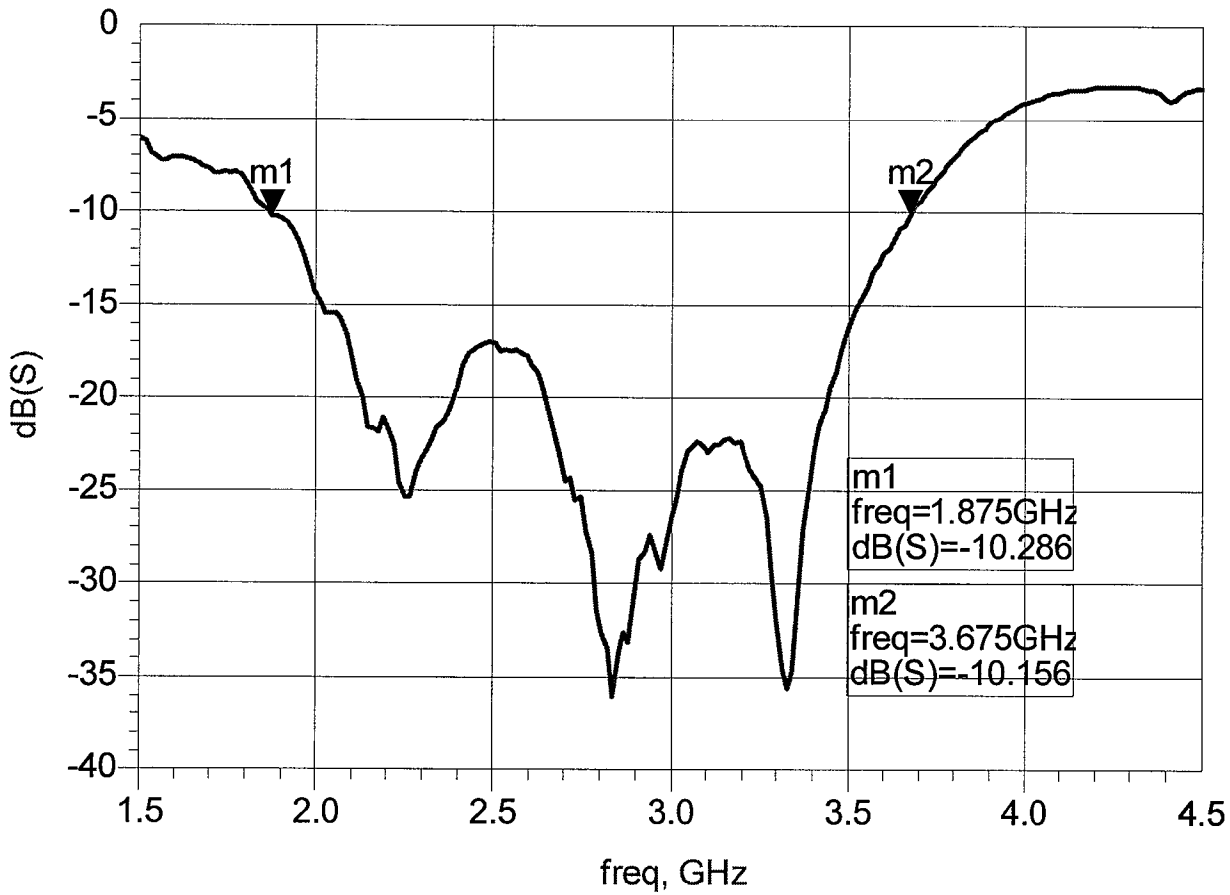
FIG. 8 is a graph showing the return loss for an exemplary four element antenna as shown in FIG. 4 constructed in accordance with the principles of the present invention.

FIG. 8 is a graph showing the return loss of the four element antenna shown in FIGS. 4, 5, and 6. As can be seen, the return loss for this antenna is below 10 dB between 1.875 GHz and 3.675 GHz. This is a frequency bandwidth of 1.80 GHz or 64.5% (1.8/2.775). In fact, the return loss in most of the frequency band is less than −15 dB. Hence, this antenna configuration could be further optimized to achieve a much larger −10 dB bandwidth.

Note that the meander antenna elements in the embodiment of FIGS. 4, 5, and 6 have the same dimensions as the meander antenna elements in the embodiments of FIGS. 1, 2, and 3. The addition of two more antenna elements in the embodiment of FIGS. 4, 5, and 6 increases the bandwidth from 1.65 GHz to 1.8 GHz. The increase in bandwidth by adding additional meander antenna elements can be much more dramatic depending on the dimensions of the antenna elements and other factors. For instance, computer simulations show that a two element meander antenna having approximately the same dimensions as the individual antenna elements of the embodiments of FIGS. 1 through 6, but having five arms instead of seven arms provides even more dramatic results. For instance, a two element meander antenna as described above having five arms has a 10 dB bandwidth between 2.085 GHz and 2.880 GHz, thus providing a bandwidth of about 800 MHz. When four meander antenna elements are embodied on the substrate, the 10 dB bandwidth extends between 1.980 GHz and 3.300 GHz for a bandwidth of 1,320 MHz. This is a result of an almost doubling of the bandwidth by adding two more antenna elements of the same dimension.

The radiation pattern of meander antennas is omni-directional and extremely uniform in general. Accordingly, extremely good performance can be obtained from the antennas illustrated in FIGS. 1-6 in a very small package. The ground plane does not need to be spaced far from the radiating meander antenna elements. These embodiments are only about 1 mm thick.

Additional meander antennas can be disposed on the opposing sides of the dielectric substrate. The number of antennas is limited only by practical considerations such as size. Three, four, or even more meander antenna elements can be disposed on each side of the substrate.

Because antennas in accordance with the present invention have such large bandwidth, these antennas can readily handle frequency changes resulting from human body loading. Peak gain is about 1.5 dBi. The gain will be smaller if a smaller ground plane is employed.

Figure 9:
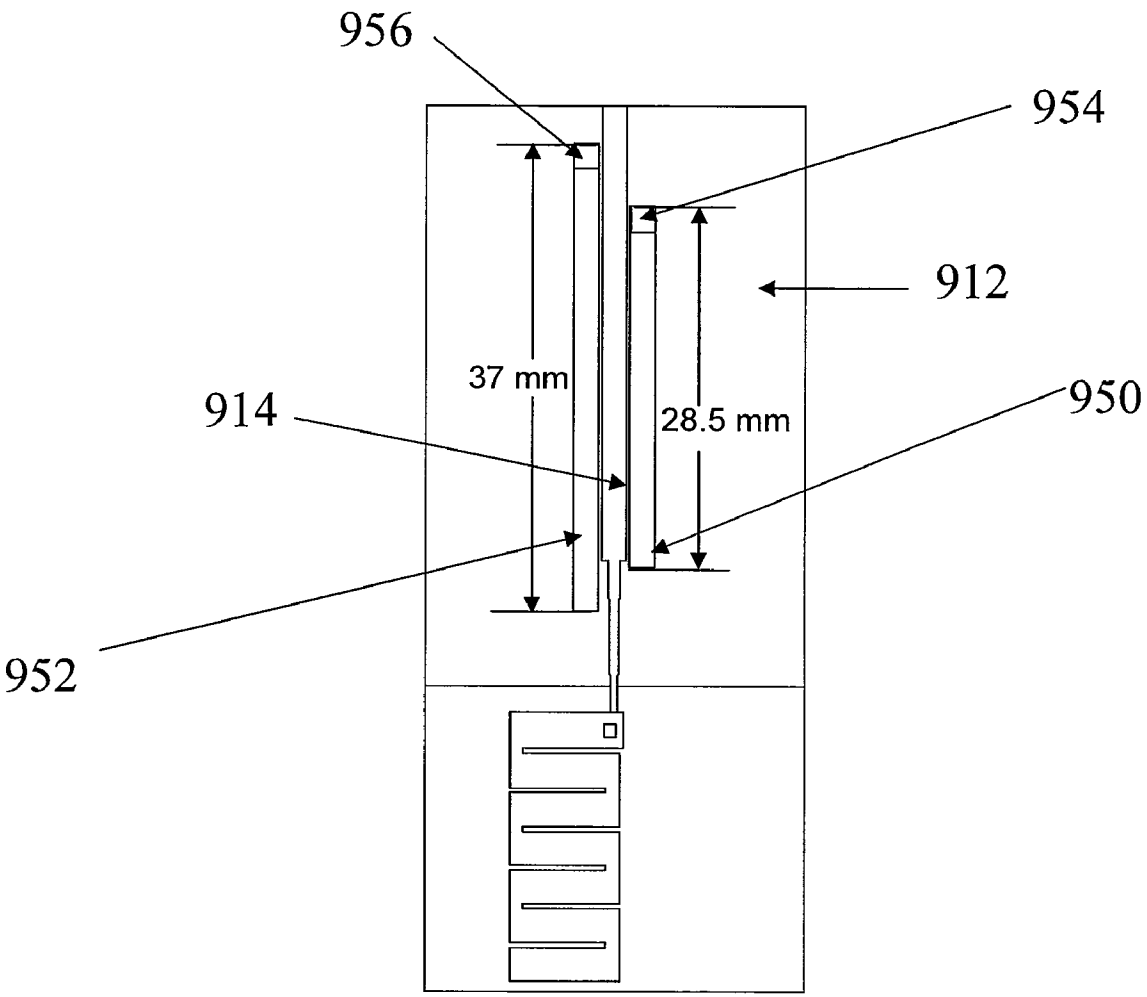
FIG. 9 is a top plan view of a two element meander antenna having two microstrip line filters in accordance with the principles of the present invention.

Filters may be disposed directly on the dielectric substrate in order to filter out (or reject) signals in certain narrow frequency bands within the broad bandwidth response of the antenna. For instance, between the frequency band of GSM and PCS are the two frequency bands for GPS (Global Positioning System). Assuming that the antenna is for a cellular telephone that does not have GPS capabilities, it may be desirable to reject the GPS frequencies to improve the performance of the antenna in the desired frequency bands, GSM and PCS. FIG. 9 illustrates such an embodiment of the invention. FIG. 9 is a top plan view of an antenna similar to the embodiment of FIGS. 1, 2, and 3, except for the addition of two quarter-wavelength microstrip lines 950,952 running parallel to and on either side of the microstrip feed line 914 and coupled to the ground plane (not shown) on the bottom surface of the substrate 912 through vias 954 and 956, respectively. Each filter is a quarter wavelength of the center frequency that it is to reject. Thus, microstrip filter line 950 is 28.5 mm in length in order to reject the higher GPS frequency at 1.2 GHz, while microstrip filter line 952 is 37 mm in length in order to reject the lower GPS frequency at 1.57 GHz. Microstrip 950 is spaced 0.2 mm from the feed line. Microstrip 952 is spaced 0.25 mm from the feed line.

Figure 10:
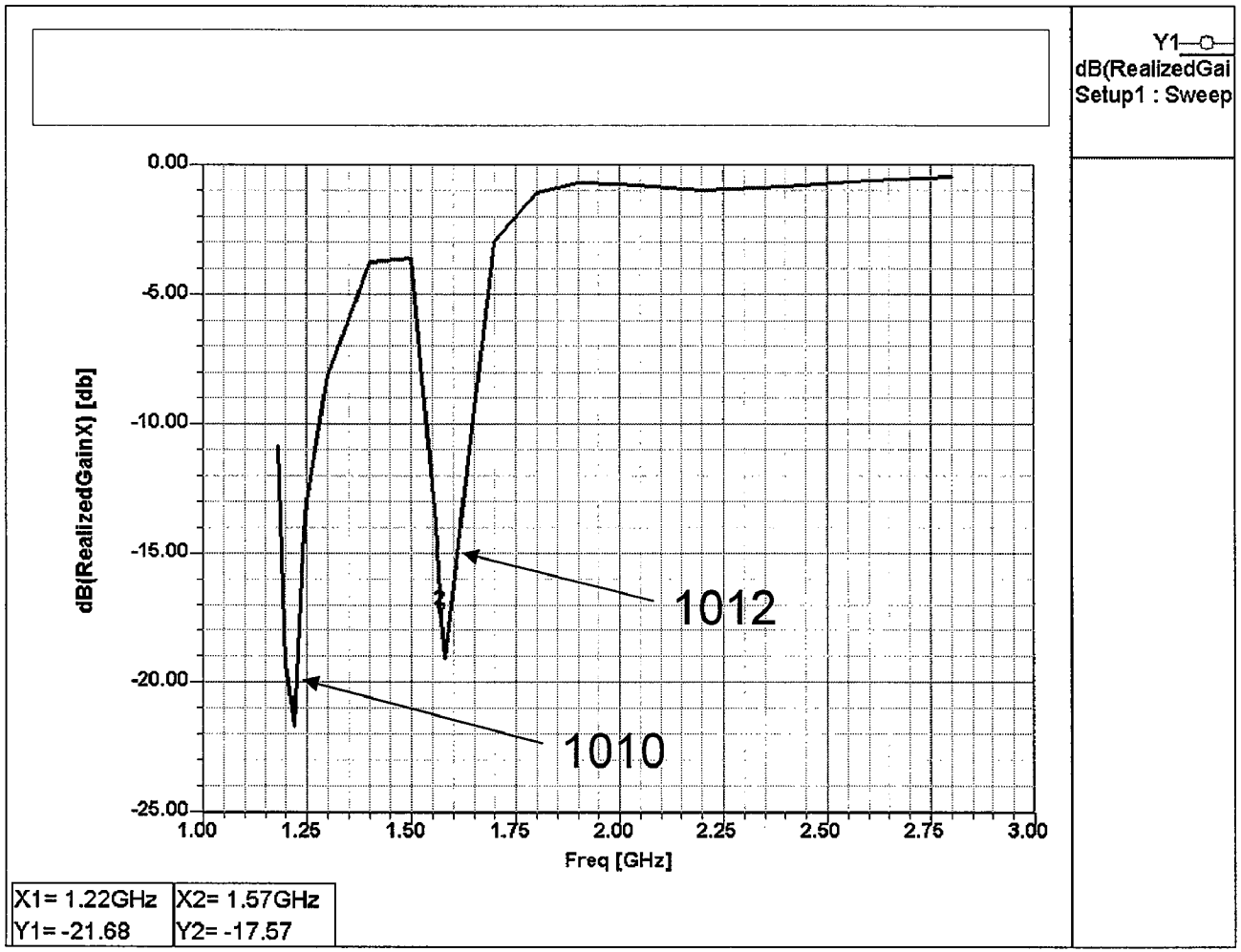
FIG. 10 is a graph showing the gain response of an exemplary two element antenna as shown in FIG. 9.
Figure 11:
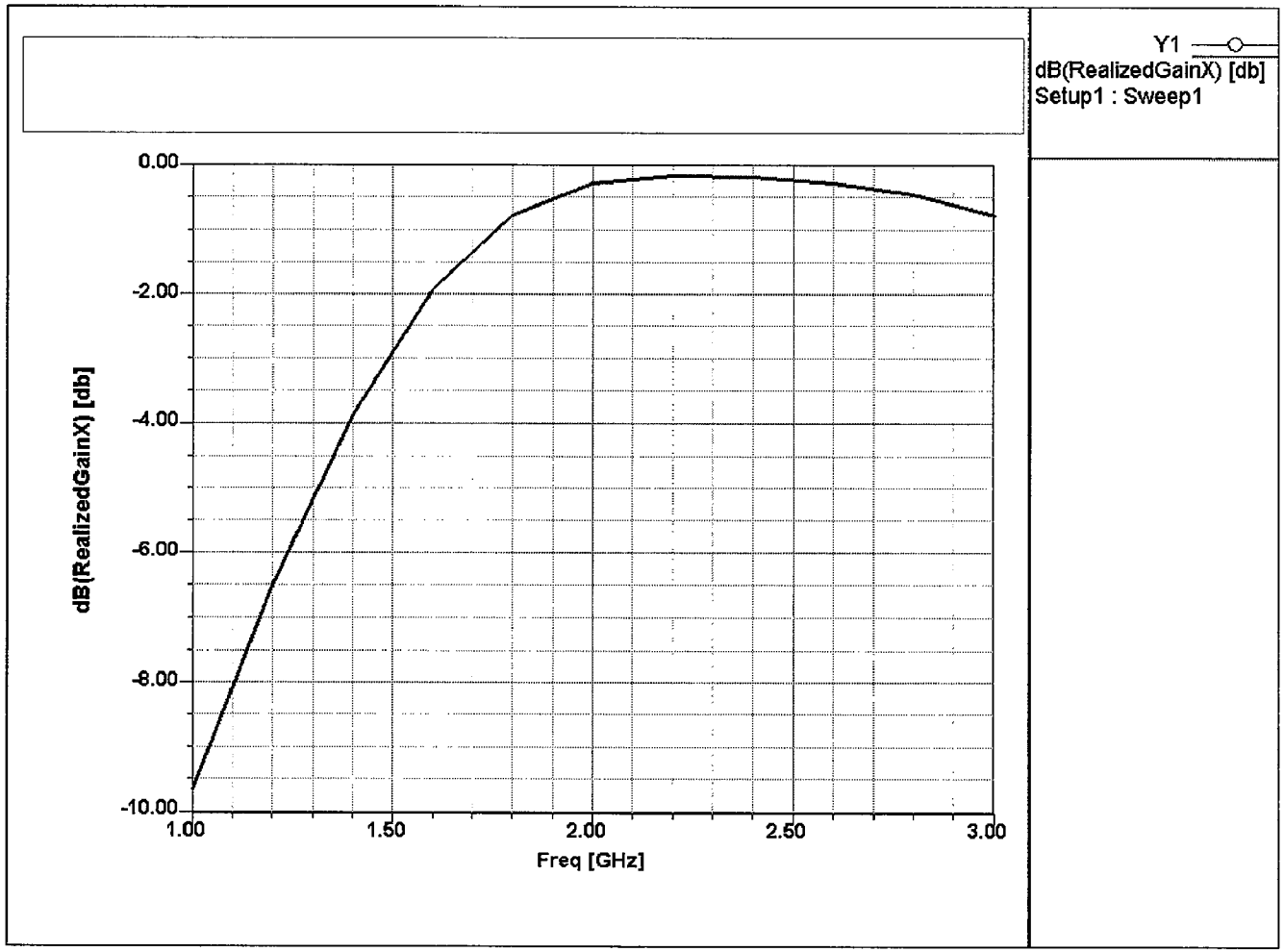
FIG. 11 is a graph showing the gain response of an exemplary two element antenna similar to the antenna of FIG. 9, except without the filters.

FIG. 10 is a graph illustrating the gain response of the antenna of FIG. 9 demonstrating excellent rejection at approximately 1.2 GHz and approximately 1.57 GHz, as shown at 1010 and 1012, respectively. FIG. 11 is a graph illustrating the gain response of an antenna like the one of FIG. 9, except without the filters. As can be seen, substantial and sharp filtering is achieved at the frequencies of 1.22 GHz and 1.57 GHz.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

The invention claimed is:

1. An antenna comprising:

a dielectric substrate comprising first and second opposing surfaces;

a first meander antenna element disposed on said first surface of said substrate and having a first resonant frequency;

a second meander antenna element disposed on said second surface of said substrate and having a second resonant frequency; and a ground plane substantially coplanar with one of said first meander antenna element and said second meander antenna element, wherein said ground plane is disposed on said second surface of said substrate and conductively isolated from said first and second meander antenna elements.

2. The antenna element of claim 1, further comprising a feed line disposed on said first surface of said substrate and conductively coupled to individually feed each of said first and second meander antenna elements.

3. The antenna of claim 2, further comprising a conductive via in said substrate between said first and second surfaces of said substrate, said via directly conductively connected to said first and second meander antenna elements and said feed line.

4. The antenna of claim 3, wherein said first and second meander antenna elements each comprise a conductive serpentine trace having a first end and a second end, and wherein said feed line comprises a conductive trace having a first end adjacent an edge of said substrate for coupling to an edge connector and a second end conductively coupled to said first ends of said first and second meander antenna elements.

5. The antenna of claim 4, wherein said substrate is less than about 5 mm thick.

6. The antenna of claim 5, wherein said substrate is about 1 mm thick.

7. The antenna of claim 3, wherein said substrate is generally rectangular and said first and second surfaces each have a transverse dimension and a longitudinal dimension and wherein said substrate comprises first and second adjacent longitudinal segments and wherein said first and second meander antenna elements are disposed in said first longitudinal segment of said substrate generally opposite each other, and wherein said ground plane and said feed line are disposed in said second longitudinal segment of said substrate generally opposite each other.

8. The antenna of claim 7, further comprising at least one second conductive via between said first and second surfaces of said substrate, said at least one second conductive via disposed adjacent said first end of said feed line.

9. The antenna of claim 8, wherein said at least one second conductive via comprises two conductive vias, each positioned on an opposite side of said feed line.

10. The antenna of claim 4, further comprising at least a first microstrip line disposed on said first surface of said substrate generally parallel and adjacent a portion of said feed line, said first microstrip conductively coupled to said ground plane and conductively isolated from said feed line and said first and second meander antenna elements.

11. The antenna of claim 10, wherein said first microstrip line comprises two microstrip lines disposed on opposite sides of said feed line and having different lengths.

12. The antenna of claim 10, wherein said antenna has a frequency bandwidth dictated by said first and second meander antenna elements collectively and said at least first microstrip line is a filter that is dimensioned to resonate at a frequency within said frequency bandwidth.

13. An antenna comprising:

a dielectric substrate comprising first and second opposing surfaces;

a first meander antenna element disposed on said first surface of said substrate and having a first resonant frequency;

a second meander antenna element disposed on said second surface of said substrate and having a second resonant frequency;

a ground plane substantially coplanar with one of said first meander antenna element and said second meander antenna element; and a third meander antenna element and a fourth meander antenna element, said third meander antenna element disposed on said first surface of said substrate and said fourth meander antenna element disposed on said second surface of said substrate.

14. The antenna of claim 13, wherein said third meander antenna element is disposed adjacent said first meander antenna element on said first surface of said substrate and said fourth meander antenna element is disposed adjacent said second meander antenna element on said second surface of said substrate.

15. An antenna comprising:

a planar dielectric substrate comprising first and second opposing surfaces and having a longitudinal dimension and a transverse dimension, said substrate comprising a first longitudinal segment and a second longitudinal segment contiguous with said first longitudinal segment and a first longitudinal edge at an end of said first longitudinal segment, a second longitudinal end at an end of said second longitudinal segment, a first side edge, and a second side edge opposite said first side edge;

a first meander antenna element disposed on said first surface and in said second longitudinal segment of said substrate, said first meander antenna element comprising a serpentine conductive trace on said first surface of said substrate comprising a plurality of straight trace segments connected to each other by a plurality of turns and having a first end and a second end;

a second meander antenna element disposed on said second surface of said substrate generally opposite said first meander antenna element, said second meander antenna element comprising a serpentine conductive trace on said second surface of said substrate comprising a plurality of straight trace segments connected to each other by a plurality of turns and having a first end and a second end;

a conductive via between said first and second surfaces of said substrate disposed between said first end of said first meander antenna element and said first end of said second meander antenna element;

a feed line comprising a generally straight conductive trace having a length in said longitudinal dimension of said substrate having a first end adjacent said first longitudinal end of said substrate and a second end directly conductively coupled to said first end of said first meander antenna element and said via, and, through said via, to said first end of said second meander antenna element; and a ground plane in said first longitudinal segment and on said second surface of said substrate and conductively isolated from said first and second meander antenna elements.

16. The antenna of claim 15, wherein said first and second meander antenna elements have the same dimensions.

17. The antenna of claim 15, wherein said substrate is less than about 5 mm thick.

18. The antenna of claim 17, wherein said substrate is about 1 mm thick.

19. The antenna of claim 15, further comprising second and third conductive vias between said first and second surfaces of said substrate disposed adjacent and on opposite transverse sides of said first end of said feed line.

20. The antenna of claim 15, further comprising a third meander antenna element and a fourth meander antenna element, said third meander antenna element disposed adjacent said first meander antenna element on said first surface of said substrate and said fourth meander antenna element disposed adjacent said second meander antenna element on said second surface of said substrate.

21. The antenna of claim 20, further comprising at least a first microstrip line disposed on said first surface of said substrate generally parallel and adjacent a portion of said feed line, said first microstrip conductively coupled to said ground plane and conductively isolated from said feed line and said first and second meander antenna elements.

22. The antenna of claim 21, wherein said first microstrip line comprises two microstrip lines disposed on opposite transverse sides of said feed line and having different lengths.

23. The antenna of claim 21, wherein said antenna has a frequency bandwidth dictated by said first and second meander antenna elements collectively and said at least first microstrip line is a filter that is dimensioned to resonate at a frequency within said frequency bandwidth.

* * * * *